US011819853B2

(12) United States Patent
Kernen et al.

(10) Patent No.: US 11,819,853 B2
(45) Date of Patent: Nov. 21, 2023

(54) COOLING APPARATUS

(71) Applicant: CTC Analytics AG, Zwingen (CH)

(72) Inventors: Roland Kernen, Muttenz BL (CH); Melchior Zumbach, Lenzburg AG (CH)

(73) Assignee: CTC ANALYTICS AG, Zwingen (CH)

( * ) Notice: Subject to any disclaimer, the term of this patent is extended or adjusted under 35 U.S.C. 154(b) by 469 days.

(21) Appl. No.: 16/738,590

(22) Filed: Jan. 9, 2020

(65) Prior Publication Data

US 2020/0215548 A1 Jul. 9, 2020

(30) Foreign Application Priority Data

Jan. 9, 2019 (EP) ..... 19151021

(51) Int. Cl.

*F25B 21/04* (2006.01)
*B01L 7/00* (2006.01)
*F25D 31/00* (2006.01)

(52) U.S. Cl.

CPC ..... *B01L 7/00* (2013.01); *F25B 21/04* (2013.01); *F25D 31/005* (2013.01); *F25D 31/006* (2013.01); *B01L 2300/0627* (2013.01); *B01L 2300/1822* (2013.01); *B01L 2300/1894* (2013.01); *F25D 2700/12* (2013.01)

(58) Field of Classification Search

CPC ..... F25B 21/04; F25D 31/005; F25D 31/006; F25D 2700/12

See application file for complete search history.

(56) References Cited

U.S. PATENT DOCUMENTS

| | | | | |
|---|---|---|---|---|
| 3,733,836 | A | 5/1973 | Corini | |
| 4,586,342 | A * | 5/1986 | Morishita | H05K 7/20336 62/3.4 |
| 5,029,446 | A * | 7/1991 | Suzuki | F25B 21/02 62/3.61 |
| 5,111,664 | A | 5/1992 | Yang | |
| 6,170,267 | B1 * | 1/2001 | Kitaoka | G01N 30/24 62/3.6 |
| 6,612,124 | B1 * | 9/2003 | Hatch | A47F 10/06 220/676 |
| 11,209,176 | B2 * | 12/2021 | Ma | F28D 15/0275 |
| 2005/0210884 | A1 | 9/2005 | Tuskiewicz et al. | |
| 2006/0207276 | A1 | 9/2006 | Daddis, Jr. et al. | |

(Continued)

FOREIGN PATENT DOCUMENTS

| | | |
|---|---|---|
| EP | 2 980 511 A1 | 2/2016 |
| WO | WO 02/055945 A1 | 7/2002 |

OTHER PUBLICATIONS

European Office Action dated Nov. 4, 2021 for Application No. 19 151 021.3.

*Primary Examiner* — David J Teitelbaum

(74) *Attorney, Agent, or Firm* — Birch, Stewart, Kolasch & Birch, LLP

(57) ABSTRACT

An apparatus (1) for cooling containers, in particular vials, comprising at least one first cooling zone (200) for receiving containers, with a cooling zone base and a cooling zone wall (201), and a cooling device (300) for cooling air, and a first duct (113) for conducting the cooled air from the cooling device (300) into the cooling zone (200), wherein an outlet of the first duct (113) is spaced apart from the cooling zone base.

15 Claims, 2 Drawing Sheets

(56) References Cited

U.S. PATENT DOCUMENTS

| | | | | |
|---|---|---|---|---|
| 2010/0212343 | A1* | 8/2010 | Swofford | A47F 3/0491 62/251 |
| 2014/0250938 | A1* | 9/2014 | Tanaka | F25D 11/00 62/426 |

* cited by examiner

COOLING APPARATUS

TECHNICAL FIELD

The invention relates to an apparatus for cooling containers, in particular vials, comprising at least one first cooling zone for receiving containers, with a cooling zone base and a cooling zone wall, and a cooling device for cooling air, and a duct for conducting the cooled air from the cooling device into the cooling zone.

PRIOR ART

In laboratory practice, samples are frequently stored in cooled form prior to being analyzed. For this purpose, diverse sample coolers are known from the prior art, with which, for example, vials and other containers can be cooled to a certain temperature.

Ideally, condensation should not form in cooling apparatuses for sample containers. In particular, the formation of condensation should be avoided in regions in which contamination may be spread. Such contamination is critical in particular in the region of the container lids, in particular on septa of vials.

During the extraction of samples, the autosampler uses a cannula to penetrate the septum of the vial. If condensation is located on the septum of the vial, the analysis result can thereby be falsified. Avoiding condensation is therefore of great importance in such apparatuses for cooling containers.

In order to reduce or to avoid the formation of condensation, it is known to flush the cooling zones with cooled and dried air or nitrogen. Flushing with nitrogen is relatively expensive because of the relatively large volumetric flows. It is also known to close the cooling zones with a lid in order to reduce formation of condensation in a boundary layer between the cooling zones and the outside air.

Such a sample cooler is disclosed, for example, by US 2010/248346 A1. This shows an analysis device comprising a housing with a first chamber; a reagent storage region in the housing with a second chamber for receiving a reagent container, and an air inlet, and also a cooling apparatus for cooling the air. The air is conducted from the first chamber through the air inlet into the second chamber. The reagent storage region comprises a closed storage body. The base of the storage body comprises a cooling apparatus with a Peltier element and a ventilator for removing the waste heat. The base is directly cooled by the cooling apparatus. An air inlet is arranged centrally at the top of the reservoir. The inlet pipe is provided with a ventilator in order to guide the air downwards into the pipe. The lower end of the pipe is formed integrally with the first reagent receptacle under which the air can be conducted through a gap. A condenser composed of a material having high temperature conductivity, such as, for example, aluminum, is located in the pipe. The condenser is in contact with the inner wall of the base, and therefore the condenser is likewise cooled by the cooler. The airflow is guided from the condenser through the gap radially through the reservoir in order then to flow back upwards and radially on the inner wall and passes again via openings into the pipe. The reservoir has holes in the lid to equalize the pressure.

The known apparatuses for cooling vials have the disadvantage that lids for covering the cooling zones are necessary in order to avoid condensation in the cooling zones. The warmer outside air is therefore prevented from coming into contact with the cooler air in the cooling zone and thus the moisture from the warmer air from condensing at the boundary layer. In order nevertheless to have rapid access to the vials, lids which have openings in the region of the vial lids are known. A syringe cannula of an autosampler, for example, can extract samples from the vial through said openings. For this purpose, however, firstly the position of the vials in the cooling zone has to be defined and secondly the lid of the cooling zone also has to be changed each time the type of vials is changed. As a result, the known apparatuses are awkward to handle.

SUMMARY OF THE INVENTION

It is the object of the invention to provide an apparatus for cooling containers, the apparatus belonging to the technical field mentioned at the beginning and reliably substantially preventing the formation of condensation in the cooling zone and at the same time being simple to handle.

The achievement of the object is defined by the features of Claim 1. According to the invention, an outlet of the first duct is spaced apart from the cooling zone base. In a particularly preferred embodiment, the outlet of the first duct is arranged in an upper half of the cooling zone with respect to the cooling zone base. The outlet is therefore preferably at a greater distance from the cooling zone base than from the cooling zone edge or the cooling zone opening.

In a method for cooling a container in a, preferably trough-shaped, cooling zone for receiving containers, with a cooling zone base and a cooling zone wall, cooled and preferably dried air is conducted in a region above the cooling zone base, in particular in a region of a cooling zone edge, into the cooling zones.

Owing to the fact that the cooling air is conducted at a distance from the cooling zone base into the cooling zones, the cooling air enters the cooling zones closer to the container lids, in particular the vial septa. A formation of condensation in the region of the container lids can therefore be effectively reduced or even prevented. By means of the continuous cooling airflow, in particular moisture which is already present and which enters the cooling zones, for example together with the vials, can also be transported away again. However, it is clear to a person skilled in the art that the sample containers do not absolutely have to be provided with a lid.

This design is of advantage in particular in the case of apparatuses for cooling sample vessels, such as vials, in which, during the storage, sample material are intended to be removed by an autosampler.

The apparatus for cooling containers can be designed as a freestanding device. Furthermore, the apparatus can also be part of an analysis device, in particular part of an autosampler.

The apparatus comprises a first, preferably trough-shaped, cooling zone for receiving vials, with a cooling zone base and a cooling zone wall. The exact shape of the cooling zone can in principle be freely selected. The cooling zone is preferably designed as a rectilinear cylinder. The cooling zone is particularly preferably of substantially cuboidal design, wherein the cooling zone wall is perpendicular to the cooling zone base. However, it is clear to a person skilled in the art that the cooling zone, in particular, for example, for receiving racks and the like, can also have projections and depressions, and therefore the cooling zone differs from the cuboidal shape, but, as before, is of substantially cuboidal design. However, the, preferably trough-shaped, cooling zone can also have, for example, the form of an open circular cylinder or other forms.

The apparatus can comprise more than one cooling zone, in particular two or more cooling zones. In a preferred embodiment, the apparatus comprises, for example, three cooling chambers arranged next to one another in a row. There is therefore the possibility, for example, of setting different temperatures in different cooling zones. Furthermore, a more homogeneous temperature distribution can be achieved in a plurality of cooling zones than in one large cooling zone corresponding to the plurality of cooling zones.

The apparatus furthermore comprises a cooling device for cooling air, and a first duct for conducting the cooled air from the cooling device into the cooling zone.

The term of the outlet with respect to the first duct is understood as meaning the outlet opening of the duct, through which outlet opening the cooling air emerges during operation. The outlet is typically defined by an opening shape, for example a round or rectangular opening shape. However, the outlet can also be designed as a valve and therefore can optionally also be controllable. In the preferred embodiment, the outlet opening is designed as an elongate slot opening which is oriented in particular parallel to a container base and/or parallel to a container opening. The cooled and dried air can therefore be guided over the vial lids of the vials stored in the cooling zone, in order to reduce condensation of air moisture.

The apparatus is preferably designed as an open apparatus for cooling containers. The apparatus therefore preferably does not comprise any lid. The apparatus is therefore preferably designed as a permanently open system. Particularly simple handling of the apparatus, in particular of the containers to be cooled, can thus be achieved. Racks, fitted with vials, can therefore be removed in an uncomplicated manner from the apparatus or inserted into the latter without a lid having to be provided for the cooling zone. In the cooling zones, the cooling airflow preferably produces a cold spot which has a stability sufficient such that a lid can be omitted.

In variants, the apparatus can comprise a lid for covering the cooling zone. The lid can comprise openings for access of an autosampler to the containers.

The airflow of the cooled air is preferably selected in such a manner that, in order to reduce formation of condensation in the cooling zone, in particular on containers located in the cooling zone, said airflow is achieved without turbulence being produced. The cooling zone is therefore typically not sufficiently cooled. The containers are preferably cooled via a direct cooling of the sample container receptacles, in particular of the racks and/or of the cooling zones themselves, in particular since the direct contact between the rack and the vials enables better heat coupling or better heat transfer to be achieved than in the case of pure air cooling. A cooling capacity by the cooling air particularly preferably lies in the region of below 25%, in particular of below 10%, of the entire cooling capacity. The cooling capacity can therefore be optimally used for cooling the vials.

In variants, a cooling capacity of more than 25% of the overall cooling capacity can also be obtained with the airflow.

The outlet of the first duct is preferably arranged at a cooling zone edge of the cooling zone wall. This means in particular that the outlet delimits the cooling zone wall. The cooling zone edge of the cooling zone wall refers to a free edge or the edge of the cooling zone. In a preferred embodiment, the cooling zone has the form of a cuboidal open container, wherein the cooling zone edge is the edge surrounding the opening. Owing to the fact that the cooling air flows at the cooling zone edge into the cooling zone, the cooled air will typically drop slowly downwards in the cooling zone because of the increased density while the warmer air rises upwards in the cooling zone. A slow, in particular laminar circulation of the air in the cooling zone is therefore achieved. The cold spot is therefore maintained in the cooling zone.

In variants, the outlet can also be arranged in a side wall of the cooling zone, and therefore the cooling zone wall also runs further vertically above the outlet. For this purpose, the side wall can be interrupted at one or more points. In particular for this purpose, the side wall can comprise ventilation slots or the like, through which the cooling air can flow into the cooling zone.

The outlet is preferably oriented horizontally, that is to say, the outlet is preferably oriented parallel to a plane defined by the cooling zone base or at a right angle to the cooling zone wall. The cooling airflow is therefore guided from above along the lids of the containers, in particular along the septa of the vials, and therefore condensation is avoided on the lids. The cooling air sinks slowly downwards in the cooling zone because of the higher density, while hotter air rises out of the cooling zone.

In variants, the outlet can also be oriented in some other way, in particular the outlet can also be inclined at an angle of less than 90° towards the container base, and therefore the cooling air is guided downwards into the cooling zone.

In a preferred embodiment, the first duct is heat-insulated. The first duct internally particularly preferably comprises heat-conducting material which can be cooled in particular via the cooling device. The cooling air can therefore be kept cool during the transportation into the cooling zone.

The airflow of the cooled and dried air is preferably guided in such a manner that the flow passes over the cooling zones in a laminar and flat manner. Condensation on container lids can therefore be optimally reduced. Alternatively, the airflow can also be geometrically selected in some other way.

The duct particularly preferably has a cross section of the shape of an elongate rectangle, in particular with a side ratio of greater than 4:1, particularly preferably of greater than 8:1. The duct and also the outlet are preferably of slot-like design. Therefore, firstly, as great a heat exchange as possible with the cooling zone wall can be achieved. Secondly, via the slot-like outlet, the cooling air can therefore be conducted particularly optimally over the containers in the cooling chamber, and therefore an extensive separating layer can be created between the outside air and the interior of the cooling zone.

In variants, the duct and/or the outlet can also have different cross sections, in particular square, round, etc.

The first duct particularly preferably comprises an air impact plate, and therefore the cooling airflow can be guided in a direction parallel to the cooling zone base. The first duct can therefore comprise a supply duct which ends before the air impact plate. Cooling air can therefore be conducted from a parallel to the cooling zone wall to an air impact plate oriented parallel to the cooling zone base. The air therefore flows out of the supply duct onto the air impact plate and is deflected by the latter and by the cooling air flowing in after.

In variants, the air impact plate can be dispensed with. In this case, for example, the first duct can have a curvature, and therefore the cooling air can be guided in the desired direction.

In a further preferred embodiment, the apparatus comprises at least two cooling zones which are separated by a partition.

In variants, the apparatus can comprise precisely one cooling zone.

The apparatus preferably comprises a partition which separates the at least two cooling zones from one another and which in particular comprises the first duct. The partition is especially preferably designed as a double wall, wherein the first duct is formed between the walls. An air impact plate is preferably arranged at the free end of the double wall, and therefore the cooling air flowing vertically upwards, as it exits from the first duct, is deflected at the air impact plate.

In variants, the double wall between the two cooling zones can also be omitted. In this case, separate cooling air ducts can also be provided. In particular, a supply duct can also be guided to the outlet in some other way. For example, a nozzle shaped as desired can be connected to the cooling device via a flexible tube. The air impact plate can correspondingly be omitted, wherein the outlet or the nozzle can be dimensioned in some other way.

The outlet preferably extends over more than 20%, preferably over approximately 50%, of a cooling zone edge of the cooling zone wall. A particularly uniform distribution of the cooling air can therefore be achieved. In particular, the first duct can be guided along a first side of a, for example, rectangular profile of the free edges of the cooling zone wall. Furthermore, it is also possible to provide a plurality of ducts which are distributed along the circumference of the free edge of the cooling zone at regular intervals or irregularly.

Alternatively, the outlet can also extend over less than 20% of the cooling zone edge. In order nevertheless to achieve a homogeneous distribution of the cooling air, a plurality of ducts having a small cross section can be provided. Furthermore, the outlet can also extend over more than 50% of the cooling zone edge, and therefore a cooling capacity can be increased.

The cooling device preferably comprises a condensate separator. The cooling air can therefore be dried before being introduced into the cooling zone, and therefore less moisture is transported into the cooling zone. Therefore, in one method, cooled and dried air is preferably conducted onto the vial septa of the vials. This has the additional advantage that moisture which has possibly entered the cooling zone can be transported away therefrom by the dry air. Owing to the fact that the dried cooling air is introduced into the cooling zone in the region of the free edges thereof, a dry boundary layer can therefore be created which prevents moisture from being able to enter the cooling zone from the outside. This is of great importance in particular in the case of continuously open or lid-free apparatuses for cooling containers.

In variants, it is also possible to dispense with the condensate separator. In particular in rooms which are already sufficiently air-conditioned, the air moisture may already be sufficiently low that condensation of air moisture in the cooling zone can be sufficiently reduced.

The cooling device preferably comprises at least one cooling element, in particular a Peltier element, which is in heat-conducting connection at one end with the condensate separator and at the other end with the cooling zone. The cooling device can therefore be used both for cooling the cooling zone and for the condensate separator, and therefore a particularly compact apparatus for cooling containers is provided.

In variants, separate cooling devices can also be used for cooling the cooling containers and the condensate separator.

The cooling device preferably comprises a Peltier element. A particularly simply constructed cooling device can therefore be created which can be constructed particularly compactly and cost-effectively. Since movable parts, such as compressors and the like, can be dispensed with, the cooling device is furthermore particularly robust. The apparatus can comprise more than one Peltier element. In a suitable arrangement, an improved temperature distribution can therefore be achieved in the cooling zone. Furthermore, firstly, temperature control of the cooling zones can therefore also be achieved, in particular at a temperature above that of the room temperature of 18 to 25° C., for example at 28° C. or at 30° C. For this purpose, the polarity of the Peltier element can merely be reversed.

In variants, instead of the Peltier element, another cooling device can also be provided, in particular a compression refrigerating apparatus and the like.

The cooling zone preferably comprises a heating plate for cooling a rack, wherein the cooling element is in heat-conducting connection with the heating plate. The heating plate can be designed, for example, as an aluminum plate which particularly readily conducts the temperature. Further possible materials are known to a person skilled in the art.

The heat-conducting connection is preferably achieved in that the cooling element, in particular the Peltier element, is connected directly to a side facing away from the cooling zone. The cooling element is particularly preferably arranged on a lower side of the cooling zone base. The cooling capacity is therefore optimally used. Alternatively, a heat-conducting connection can be provided between the cooling element and the cooling zone base, in particular, for example, a heat pipe. The cooling element also does not absolutely have to be connected directly or indirectly to the cooling zone base, for example, alternatively or additionally, one or more sides of the cooling zone wall could also be in heat-conducting connection with the cooling element, and therefore said sides can (also) be cooled.

In variants, instead of the heating plate, it is also possible for the rack to be cooled directly.

The condensate separator is preferably in heat-conducting connection with the cooling element, in particular exclusively via a heat pipe, in particular a heat pipe with a filling of water. The condensate separator can therefore be cooled via said cooling device, such as the cooling zone itself, in particular the heating plate of the cooling zone. A cost-effective and compactly constructed apparatus for cooling containers is therefore achieved.

Alternatively, the cooling zone or the heating plate of the cooling zone can be cooled via a separate second cooling device. The condensate separator can therefore be controlled independently of the second cooling device.

The condensate separator is preferably connected to the cooling element via a heat pipe. This has the advantage that the heat can be transported particularly efficiently. This is of advantage in particular whenever the condensate separator is spaced apart from the cooling element. The condensate separator is particularly preferably connected to the cooling element via a heat pipe with a filling of water. The filling of water freezes at temperatures below 0° C., and therefore the heat exchange comes to a standstill. This property has the advantage, during the cooling of the condensate separator, that it can therefore be prevented in a simple manner that the condensate separator ices up. The condensate separator can therefore be of self-regulating design, and therefore a particularly robust and simply constructed apparatus is created.

In variants, the condensate separator can also be in heat-conducting connection with the cooling element in some other way. In the event of short distances, for example, a heat-conducting metal element, for example aluminum or the like, can be provided as the connecting element.

The condensate separator preferably comprises a condensate collector which is air-tight in a condensate flow direction. This prevents moist air from being guided to the condensate separator via the condensate collector. The efficiency of the condensate separator can thereby be maintained.

In variants, the air-tight design of the condensate collector can be dispensed with in the direction of the condensate flow direction, in particular if the capacity of the condensate separator is selected to be of a sufficient magnitude.

The condensate collector preferably comprises a siphon, in particular a flat siphon. It can therefore be effectively prevented in a simple manner that outside air passes to the condensate separator counter to the condensate flow direction. The design as a flat siphon permits a particularly compact design of the apparatus.

In variants, the siphon can be dispensed with. In this case, for example, a closed container can be provided as condensate collector.

The condensate collector preferably comprises a line with which the condensate can be guided to a hot side of the cooling element for evaporation purposes. Monitoring of a filling level of a condensate-collecting container can therefore be dispensed with. By means of the continuous evaporation of the condensate, an apparatus which is constructed particularly simply in terms of design and also in terms of operation is achieved. In addition, the hot side of the cooling element can therefore be cooled at the same time.

In variants, the condensate can also be supplied directly to a spout or the like via a line.

The hot side of the cooling element preferably comprises a ventilator for cooling purposes. The heat generated during the cooling can therefore be removed efficiently. In particular in a variant in which the condensate from the condensate separator is intended to be evaporated on the hot side of the cooling element, the moist air can be efficiently transported away with the ventilator. In order to optimize the cooling capacity, further measures known to a person skilled in the art can be taken, for example cooling ribs can be provided.

In variants, the ventilator can also be dispensed with. The heat can also be removed via a chimney effect or the like, for example via a rising pipe. Depending on the heat to be removed, it is also possible for exclusively cooling ribs to be provided.

The apparatus preferably comprises a second duct for supplying air to the cooling device, wherein an air inlet of the second duct is arranged on a side of the apparatus opposite the ventilator. A separation of the removed hot air, which under some circumstances contains the evaporated condensation, from the air to be cooled and to be dried is therefore achieved. The ventilator is preferably arranged on a lower side and the air inlet is arranged on an upper side of the apparatus. This design is of particular advantage since the cooling element is typically arranged below the cooling zone and the ventilator for the waste heat is therefore likewise arranged on the lower side of the cooling zone. In particular when the apparatus is installed in a plate-like element, the air inlet and the ventilator can thus be spatially separated by the plate-like element. It is therefore prevented that the hot exhaust air of the ventilator passes to the air inlet of the second duct.

In variants, the air inlet of the second duct can also be arranged in some other way with respect to the ventilator. In particular, in a suitable orientation, the air inlet and the ventilator can also be arranged next to each other. Furthermore, the waste heat of the hot side of the cooling element can also be transported away via a heat line, for example via a heat pipe or the like.

The cooling element preferably comprises a first heat sensor and an edge region of the cooling zone comprises a second heat sensor for controlling a cooling capacity. The temperature in the cooling zone can therefore be controlled with a small number of heat sensors. For the control, the cooling capacity of the cooling element and the conveying capacity of the cooling air can be activated. The latter can be undertaken via a cooling air ventilator and/or via a valve, and therefore the supply of cooling air can be varied. Furthermore, the temperature sensors can be used for quality control. In particular, for example, a band width of the temperature and maxima and minima can therefore be determined. Such measurement data can be important for evaluating the analysis results.

In variants, a control of the temperature range can also be dispensed with.

The apparatus preferably comprises an outer wall with protruding supporting elements, in particular an encircling flange, with which the apparatus can be inserted into an opening and supported at the opening via the supporting elements. A particularly simple mount for the apparatus is therefore created. In particular, a ventilator arranged on the lower side can therefore be spaced apart from the floor in a simple manner, in particular without supports or a special substructure and the like, and therefore an accumulation of heat can be avoided.

In variants, the apparatus can also be designed in such a manner that it can stand freely. A person skilled in the art knows any number of variants for this purpose.

The cooled and dried air is preferably conducted substantially at a right angle to an opening direction of the cooling zone, in particular on vial septa of the vials. Formation of condensate on the vial lid, in particular the vial septa, can therefore be optimally avoided.

Alternatively, the cooled and dried air can also be conducted into the cooling zone in some other way.

The cooled and dried air is preferably conducted as a laminar airflow into the cooling zone. In variants, the cooled and dried air can also be conducted into the cooling zone as a turbulent airflow.

The cooling zone is preferably cooled with a cooling element, wherein a temperature of the cooling zone is controlled with reference to measurement data of a temperature sensor arranged on the cooling element and with reference to measurement data of a temperature sensor arranged in the region of a free edge of the cooling zone wall. The temperature of the cooling zones can therefore be optimally controlled with a small number of temperature sensors. Alternatively, more or fewer than the two temperature sensors can also be provided. The temperature sensors can also be arranged in some other way.

The cooling element is preferably heated, wherein in particular the cooling element is designed as a Peltier element, wherein the heating is achieved by reversing the polarity of the Peltier element. The heating of the cooling element firstly enables the temperature of the cooling zones to be controlled. Secondly, for example, the condensate separator can be dried therewith.

It is also possible to dispense with the heatability of the cooling elements. Furthermore, heating elements separate from the cooling element can also be provided, with which the cooling zones and/or the condensate separator can be heated.

Further advantageous embodiments and combinations of features of the invention emerge from the following detailed description and the entirety of the patent claims.

BRIEF DESCRIPTION OF THE DRAWINGS

In the drawings used for explaining the exemplary embodiment.

In principle, the same parts are provided with the same reference signs in the figures.

Ways for Implementing the Invention

Figure 1:
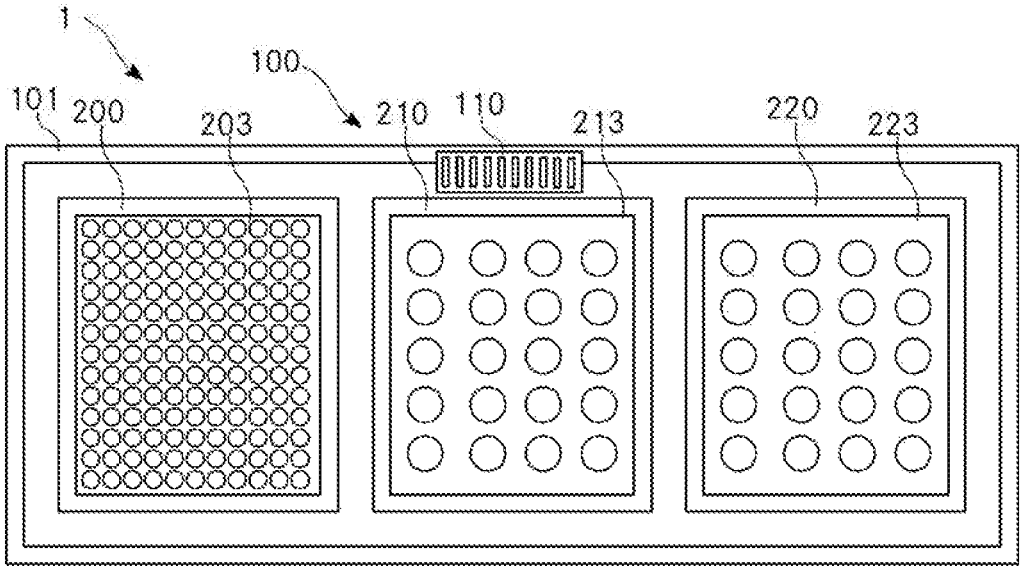
FIG. 1 shows a schematic top view of a cooling apparatus for cooling vials.

FIG. 1 shows a schematic top view of a cooling apparatus 1 for cooling vials. The present embodiment of the cooling apparatus 1 comprises a housing 100 in which three cooling zones 200, 210 and 220 are arranged. The cooling zones 200, 210, 220 are each separated from one another by walls. Racks 203, 213, 223 for receiving vials are admitted into the cooling zones 200, 210, 220, respectively. The receptacles have different diameters, and therefore vials of different size can be used.

The present cooling apparatus does not comprise any lid, and therefore the racks 203, 213, 223 can be freely exchanged between the cooling zones 200, 210, 220. However, in an alternative embodiment, the container can be provided with a lid. The latter either has to be removed for extracting a sample, or the rack has to have corresponding openings such that, for example, an autosampler can extract a sample through the openings.

Figure 3:
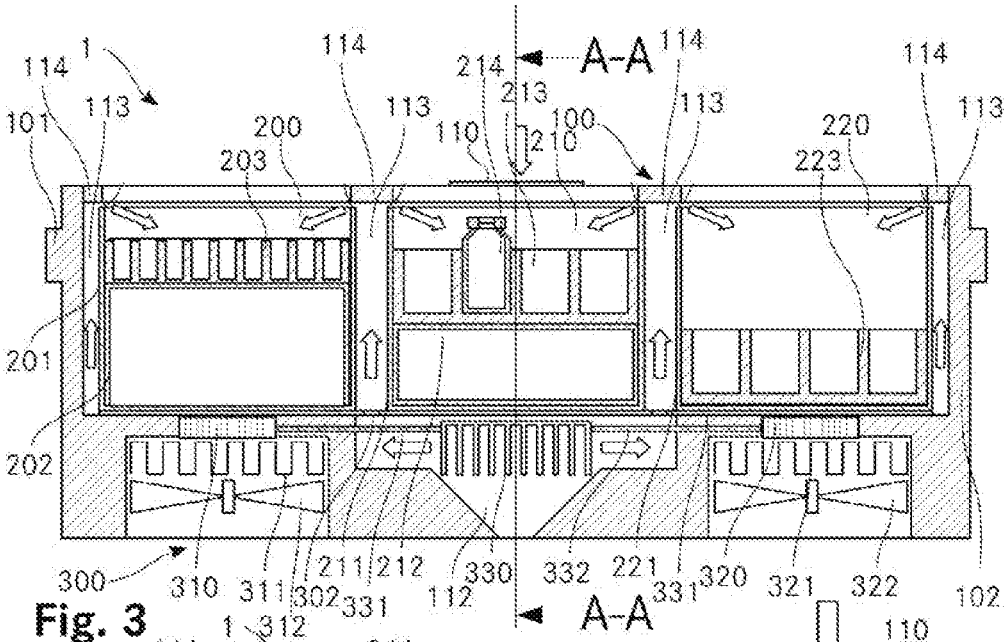
FIG. 3 shows a schematic sectional illustration through the cooling apparatus according to FIG. 1 along a vertical plane.
Figure 4:
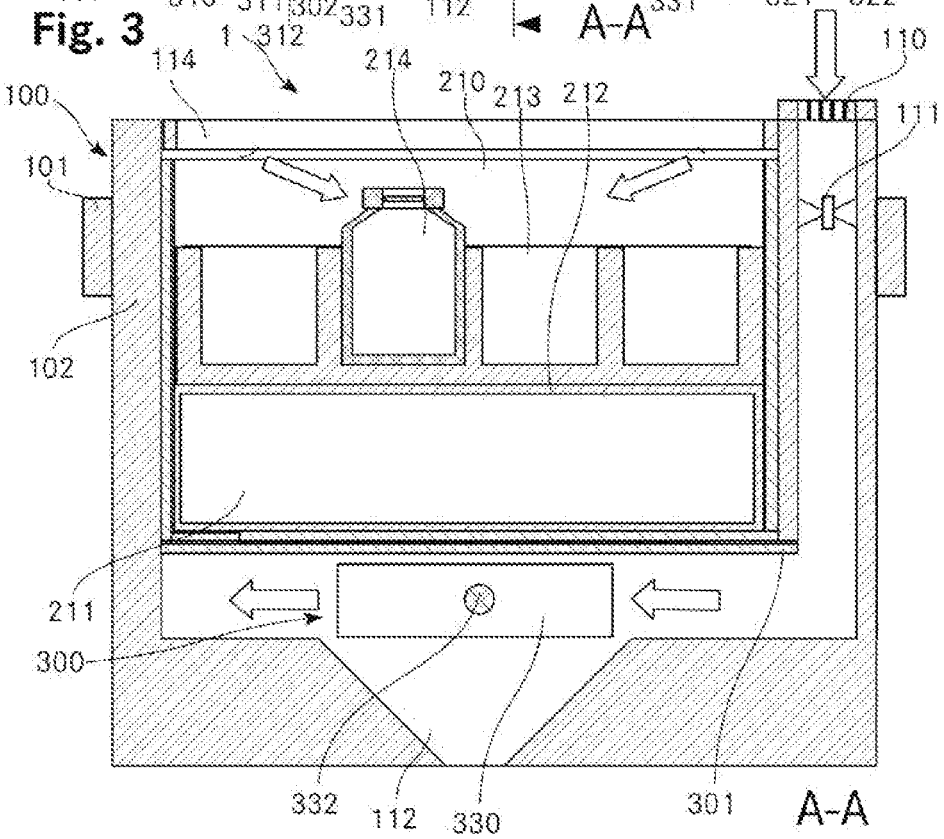
FIG. 4 shows a schematic sectional illustration of the cooling apparatus along an intersecting plane perpendicular to the intersecting plane of FIG. 3.

The housing furthermore comprises an intake shaft 110 for outside air which is cooled by a cooling device 300 for cooling the containers (see, for this purpose, FIGS. 3 and 4). The housing 100 comprises a flange 101 encircling the outside, and therefore the cooling apparatus 1 can be supported on an opening edge of a mounting plate 400.

Instead of the three cooling zones 200, 210, 220 the cooling apparatus 1 can also have more cooling zones, in particular, for example, four, five or more cooling zones. On the other hand, the cooling apparatus 1 can also merely comprise one or two cooling zones.

Figure 2:
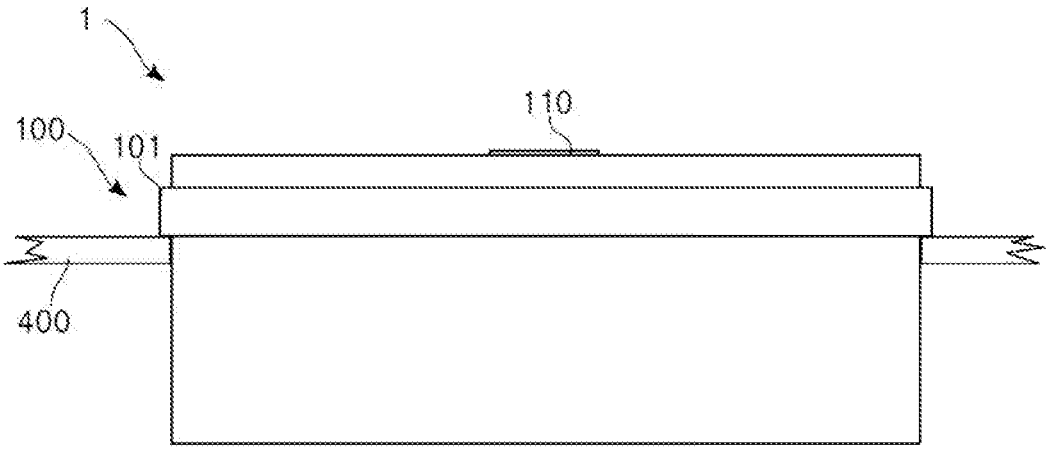
FIG. 2 shows a schematic side view of the cooling apparatus according to FIG. 1.

FIG. 2 shows a schematic side view of the cooling apparatus 1 according to FIG. 1, wherein the cooling apparatus 1 is admitted into an opening in a mounting plate 400. The cooling apparatus 1 is supported on the mounting plate 400 via the flange 101. By means of the encircling flange 101, a sealing effect can be achieved between flange 101 and mounting plate 400. Said mounting variant is of advantage in particular when the cooling device 300 for cooling the cooling apparatus 1 is arranged in the base region. A particularly compact constructional form of the cooling apparatus 1 can therefore be achieved. However, it is clear to a person skilled in the art that the cooling apparatus 1 can also be supported on feet, can be fastened to a wall or can be supported in some other way. The type of optimum support substantially depends on the required supply and removal of air for cooling the cooling zones 200, 210, 220.

FIG. 3 shows a schematic sectional illustration through the cooling apparatus 1 according to FIG. 1 along a vertical plane. The intersecting plane runs centrally through all three cooling zones 200, 210, 220.

The housing 100 comprises an insulated outer wall 102 to which the encircling flange 101 is also connected. The outer wall 102 is formed here from plastic. In the interior of the container, the three cooling zones 200, 210, 220 can be seen in cross section. Each of the cooling zones 200, 210, 220 comprises a cooling zone wall 201, 211, 221. The cooling zones 200, 210, 220 are formed here from aluminum because of the good heat conductivity. However, they can also be formed from steel or from other materials which readily conduct the heat.

In the cooling zone 200, a rack 203 is arranged on a rack substructure 202. The rack 203 comprises a multiplicity of receptacles for vials. A height of the vials is compensated for by the rack substructure 202. The rack substructure 202 is relatively high here since the rack 203 is designed for receiving vials of low height. The rack substructure 202 and also the rack 203 itself are formed here from aluminum. A rack substructure 212 of aluminum, which carries a rack 213, is arranged in turn in the cooling zone 210. The rack 213 is designed for receiving larger vials, and therefore the rack substructure 212 has a lower height than the rack substructure 202. The rack 213 is likewise formed from aluminum. Finally, a rack 223 of aluminum, for large vials, that is to say without a rack substructure, is arranged in the cooling zone 220.

In a further embodiment, the cooling zone walls 201, 211, 221 are formed from plastic. In this embodiment, the racks 203, 213, 223 are respectively cooled by the Peltier elements 310, 320. For this purpose, as already mentioned above, the racks are formed from a material which readily conducts the heat, in particular, for example, from aluminum, steel or the like.

The cooling apparatus 1 comprises a cooling device 300 for cooling the cooling zones 200, 210, 220 and for cooling a condensate separator 330. The cooling apparatus comprises a first Peltier element 310 which is connected to a base of the first cooling zone 200. The cooling zone 200 and, indirectly via the rack substructure 202, the rack 203 can therefore be cooled by the Peltier element 310. Cooling ribs 311 which are cooled with outside air by a ventilator 312 are arranged on the side of the Peltier element 310 opposite the cooling zone 200.

The cooling apparatus furthermore comprises a second Peltier element 320 which is connected to a base of the third cooling zone 220. The cooling zone 220 and therefore the rack 223 can therefore be cooled by the Peltier element 320. Cooling ribs 321 which are cooled with outside air by a ventilator 322 are arranged on the side of the Peltier element 320 opposite the cooling zone 220.

The cooling zone 210 which is located in the center between the cooling zones 200 and 220 is not directly cooled by a Peltier element. Instead, the base of the cooling zone 210 is connected to the bases of the cooling zones 200 and 220 via an aluminum plate 301. The heat can be conducted to the two Peltier elements 310 and 320 by means of the aluminum plate 301, and therefore the cooling zone 210 in the center can be cooled. In an alternative embodiment, the central cooling zone 210 can also be cooled via a third Peltier element.

A condensate separator 330 is arranged below the third cooling zone 210, but thermally decoupled therefrom. An insulation layer can additionally be provided (not illustrated here) between the condensate separator 330 and the aluminum plate 301. The condensate separator 330 comprises cooling ribs through which the outside air is guided. The outside air is therefore cooled, and therefore the air moisture condenses at the cooling ribs. The outside air is therefore simultaneously cooled and dried before it is guided into the cooling zones 200, 210 and 220.

In the present embodiment, the condensate separator does not comprise a dedicated cooling device, but rather is cooled by the two Peltier elements 310, 320 via heat conduction. In the preferred embodiment, the heat is transmitted with heat pipes 331, 332, in particular with water-filled heat pipes 331, 332. The heat pipe 331 connects the condensate separator 330 to the Peltier element 310 in a heat-conducting manner and the heat pipe 332 connects the condensate separator 330 to the Peltier element 320. An identical cooling capacity is achieved in the cooling zones 200 and 220 by the symmetrical coupling of the Peltier elements 310 and 320 to the condensate separator 330. Owing to the fact that the heat pipes are filled with water, the temperature of the condensate separator 330 is kept at above 0° C. in a self-regulating manner. If the temperature of the heat pipe drops below 0° C., the water flow and therefore the transport of heat comes to a stop, and therefore the condensate separator 330 cannot ice up.

The condensation drips downwards into a condensate-collecting shaft 112. In a manner which is not illustrated, the condensation is either collected in a container or is supplied, preferably via a siphon, to the hot side of the Peltier elements 310, 320 such that the condensation can be evaporated there. Monitoring of the condensation can therefore be dispensed with. The efficiency of the condensate separator is increased by separating the condensate collector from the outside air.

Air-guiding shafts 113, which are formed by the cooling zone walls 201, 211, 221 are arranged between the cooling zones 200, 210, 220. For this purpose, the aluminum plate 301 is provided with holes 302, and therefore the cooling air can pass from the condensate separator 330 through the holes 302 into the air-guiding shafts 113.

In an alternative embodiment, further air-guiding shafts 113 can be formed in the intermediate spaces between the cooling zones 200, 210, 220 and the inner side of the outer wall 102 of the housing 100, and therefore the air-guiding shafts 113 can be provided along all of the cooling zone walls 201, 211, 221. The cooling capacity can therefore be uniformly distributed optimally to all of the cooling zones 200, 210, 220.

Air impact plates 114 are in each case arranged above the air-guiding shafts 113, said air impact plates deflecting the airflow by an angle of 90°, and therefore the cooled and dried air is conducted into the cooling zones 200, 210, 220.

Since the cooled and dried air passes from above into the cooling zones 200, 210, 220, a separating layer with respect to the outside air is achieved, and it is therefore possible to prevent condensation from being able to form on the vials (here, for example, on the vial 214 in the cooling zone 210).

FIG. 4 shows a schematic sectional illustration of the cooling apparatus 1 along an intersecting plane A-A perpendicular to the intersecting plane of FIG. 3. The housing 1 comprises an intake shaft 110 through which outside air is sucked. For this purpose, a ventilator 111 is located in the intake shaft 110. The intake shaft 110 for the outside air to the condensate separator 330 where said outside air is cooled. The air moisture therefore condenses at the condensate separator 330. The now cooled and dried air is subsequently guided upwards through the air-guiding shafts 113 between the cooling zones 200, 210, 220 where it is conducted at the air impact plates 114 into the cooling zones 200, 210, 220. The cooled and dried air is conducted over the lids of the vials 214 such that condensing of outside air on the lids can be avoided or at least reduced.

In the present cooling apparatus, the outside air is sucked upwards whilst the waste heat is output downwards. Since the cooling apparatus is admitted in a recess of a plate via the encircling flange, the two systems can be held separately from each other. This prevents, for example, the hot exhaust air of the Peltier elements reaching the intake shaft. However, this problem can also be solved in some other way; arbitrary techniques are known to a person skilled in the art. In particular, for example, the intake shaft can be further separated from the waste heat of the Peltier elements via an extended duct.

The cooling apparatus can also comprise more than the two Peltier elements. The temperature can therefore be kept more homogeneous in the cooling zones.

It is clear to a person skilled in the art that it is not absolutely necessary for all of the cooling zone walls to be provided with air-guiding shafts. The air-guiding shafts can also be formed merely in regions. In addition, the air-guiding shafts do not absolutely have to be provided for cooling the cooling zones.

It is clear to a person skilled in the art that the temperature of the cooling zones can also be controlled with the Peltier elements, in particular at a temperature above the customary room temperature, for example at 30° C.

Instead of a Peltier element, other cooling apparatuses known to a person skilled in the art can also be provided. The heat transfer between the Peltier element and the cooling zones 200, 220 does not have to take place directly, but can also take place via a heat carrier, in particular a heat pipe.

In summary, it should be emphasized that, according to the invention, an apparatus for cooling sample containers is provided which is particularly simple to handle and, in addition, can at least effectively minimize the formation of condensation on the sample containers.

The invention claimed is:

1. Apparatus for cooling containers, comprising at least one first cooling zone for receiving containers, with a cooling zone base and a cooling zone wall, and a cooling device for cooling air, and a first duct for conducting the cooled air from the cooling device into the cooling zone, wherein an outlet of the first duct is spaced apart from the cooling zone base, the cooling device comprises a condensate separator, wherewith air can be dried before conducting the air into the first cooling zone;

wherein the cooling device comprises at least one cooling element which is in heat-conducting connection at one end with the condensate separator and at the other end with the cooling zone.

2. The apparatus according to claim 1, wherein the apparatus is designed as an open apparatus for cooling containers.

3. The apparatus according to claim 1, wherein the outlet of the first duct is arranged at a cooling zone edge of the cooling zone wall.

4. The apparatus according to claim 3, wherein the outlet extends over more than 20% of the cooling zone edge of the cooling zone wall.

5. The apparatus according to claim 1, wherein the cooling zone comprises a heating plate for cooling a rack, wherein the cooling element is in heat-conducting connection with the heating plate.

6. The apparatus according to claim 1, wherein the condensate separator is in heat-conducting connection with the cooling element.

7. The apparatus according to claim 6, wherein the condensate separator is in heat-conducting connection with the cooling element exclusively via a heat pipe.

8. The apparatus according to claim 7, wherein the heat pipe is filled with water.

9. The apparatus according to claim 1, wherein the condensate separator comprises a condensate collector which is air-tight in a condensate flow direction.

10. The apparatus according to claim 9, wherein the condensate collector comprises a siphon.

11. The apparatus according to claim 1, wherein the apparatus comprises a ventilator for cooling the hot side of the cooling element.

12. The apparatus according to claim 11, wherein the apparatus comprises a second duct for supplying air to the cooling device.

13. The apparatus according to claim 1, wherein the cooling element comprises a first heat sensor and an edge region of the cooling zone comprises a second heat sensor for controlling a cooling capacity.

14. The apparatus according to claim 1, wherein the apparatus comprises an outer wall with protruding supporting elements.

15. The apparatus according to claim 1, wherein the containers are vials.

* * * * *